US006000565A

United States Patent [19]

Ibeagwa

[11] Patent Number: 6,000,565

[45] Date of Patent: Dec. 14, 1999

[54] WEANING BINDER FOR NURSING (FEEDING) BOTTLES

[76] Inventor: Christian C. Ibeagwa, P.O. Box 3321 222 Merchandise Mart Plaza, Chicago, Ill. 60654-0321

[21] Appl. No.: 08/554,270

[22] Filed: Nov. 6, 1995

[51] Int. Cl.[6] ..... A61J 9/08

[52] U.S. Cl. ..... 215/11.6; 215/13.1

[58] Field of Search ..... 215/11.6, 11.1, 215/13.1

[56] References Cited

U.S. PATENT DOCUMENTS

| | | | |
|---|---|---|---|
| D. 310,720 | 9/1990 | Nielson | D24/47 |
| D. 325,783 | 4/1992 | Anderson | D24/193 |
| 978,892 | 12/1910 | Janssen | 215/11.6 |
| 1,182,042 | 5/1916 | Rubin | 215/11.6 |
| 1,669,061 | 5/1928 | Meltzer | 215/11.6 |
| 2,150,835 | 3/1939 | Kazimirow | 215/11.6 |
| 2,311,397 | 2/1943 | Kazimirow | 215/11.6 |
| 2,685,319 | 8/1954 | Swasko | 215/11.6 X |
| 2,729,259 | 1/1956 | Abrams | 215/11.6 X |
| 4,153,170 | 5/1979 | Aquarian | 215/11 R |
| 5,150,800 | 9/1992 | Sarter-Sarter | 215/11.4 |

FOREIGN PATENT DOCUMENTS

| | | | |
|---|---|---|---|
| 739826 | 1/1993 | France | 215/11.6 |
| 766082 | 1/1957 | United Kingdom | 215/11.6 |
| 2003039 | 3/1979 | United Kingdom | 215/11.6 |
| 2265315 | 9/1993 | United Kingdom | 215/11.6 |

*Primary Examiner*—Sue A. Weaver

[57] ABSTRACT

A tubular shaped binder for nursing (feeding) bottles, its surfaces are covered with smooth and soft textured materials; beneath the covering of the binder, batting filler (20) is embedded, and the binder is formed is with a device; its function is to keep the baby's food warm, and at the center of the binder, a longitudinal through hole is formed through which the nursing (feeding) bottle is inserted and fastened with a spring member; as a result, the nipple of the nursing (feeding) bottle will protrude beyond the surface of the top opening or the orifice of the binder so as to be used by the infant in the weaning process for physical feeding and for therapeutical that involves touching, holding or grasping of the binder as a substitute for natural breast.

4 Claims, 3 Drawing Sheets

WEANING BINDER FOR NURSING (FEEDING) BOTTLES

FIELD OF INVENTION

The present invention relates to method and a binder for nursing (feeding) bottles for weaning children that primarily incorporates feeding by using any nursing (feeding) bottle with a suitable nipple for infants and by touching, holding or grasping the binder, infants are trained to associate the binder with the natural breast in the course of their weaning process.

DESCRIPTION OF THE PRIOR ART—NURSING (FEEDING) BOTTLES

The Prior Art Nursing (feeding) bottles exacerbate weaning problems for a lot of parents with weaning children because, unlike the softness of the natural breast infants are accustomed to the brittle or plastic contained feeding bottles do not convey the baby's feeling of touch (tactile) during weaning process. Babies reciprocally need the same touching, holding, and affection parents did while breast feeding. In addition, the Prior Art Nursing (Feeding) Bottle's lack of the softer texture of the natural breast in turn, reduces adequate and proper physical nutrition that most weaning babies need.

Therefore, it is an object of the present invention to provide a binder for nursing (feeding) bottles which will obviate and mitigate the above mentioned problems parents of weaning children

SUMMARY OF OBJECTS OF THE INVENTION

The present invention relates to tubular shape Binder for nursing (feeding) Bottles. It is the primary purpose and object of the present invention to provide a weaning device comprising a longitudinal through hole a passage for the Nursing (Feeding) Bottle and a means to warm the baby's food within the Nursing (Feeding) Bottles.

Another objects of the present invention is to provide a weaning device useful for weaning process whereby an infant could make an easy transition to bottle feeding by switching from the breast to bottle without any fuss or rancor.

Since other people other than the nursing mother will probably feed an infant some of the time, therefore another object of the present invention is to provide a weaning device which alleviates the proximity and physical contact problems that most nursing mothers encounters during weaning process because babies in the course of weaning resist the conventional Nursing (Feeding) Bottles.

Another object of the present invention is to provide a weaning device that is convenient in use, easily sanitized, very light portable and will encourage continuous physical nourishment of infants.

Yet further objects of the present invention is to provide a weaning device which is economically produced and in addition adapted to receive any conventionally available Nursing (Feeding) Bottles with assorted nipples, sizes and lengths.

Briefly these objects, merits, and fuller understanding of the present invention are accomplished within its entirety by putting approximately 200 to 300 milliliters of water approximately between 25° C. to 70° C. through an inlet of the binder and then closes it. The binder helps to keep the baby's food warm as some amount of heat transfer to the baby's food is accomplished thereby the baby's food will retain or absorb some amount of heat if so desired, and this retained energy lasts for a sufficient desired period of time. Moreover, which enables parents and their infants to conveniently utilize this source of heat energy during a trip.

Next, is to insert the Nursing (Feeding) Bottle with its cap tightly closed through the longitudinal passage of the binder such that the nipple will protrude beyond the stretchable top opening of the binder, an orifice, and to secure and to fasten the Nursing (Feeding) Bottle with the spring assembly of the binder. After being secured and fastened to the binder, the nursing (feeding) bottle itself provides rigidity to the binder.

The bottle satisfies babies who need to suck. In the course of training babies to switch from breast to a bottle, the weaning process is gradually achieved by not restraining the baby's hands while feeding because it is part of the feeding process. Also, while grasping or holding on to the binder during feeding, the baby is trained to get used to and to feel a new texture which invariably conditions the infant's response to a natural breast.

Finally, before and after use, the binder including the Nursing (Feeding) Bottle can be washed and rinsed with detergent and disinfectant substance especially the longitudinal through hole of the binder.

The surface of the binder can be cleansed by wiping with a light brush and a disinfectant spray or cotton or clean piece of cloth soaked in a disinfectant substance. Nevertheless, further objects and accomplishments of the present invention will become apparent from a consideration of the ensuing description and drawings.

DETAILED DESCRIPTION OF THE PREFERRED EMBODIMENT

Description and Operation of FIGS. 1 TO 9

Figure 5:
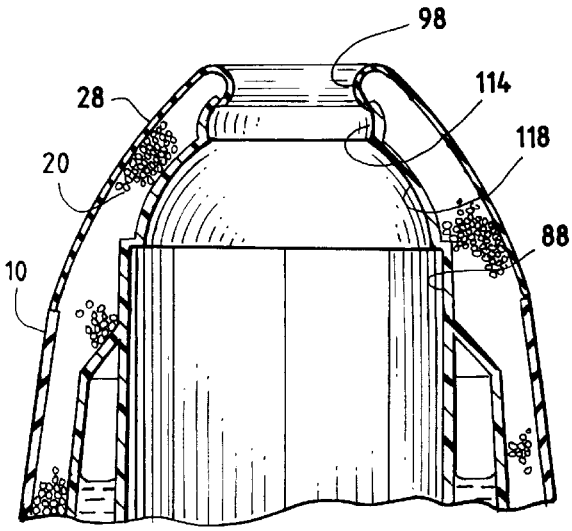
FIG. 5 is an enlarged sectional view of the top.
Figure 6:
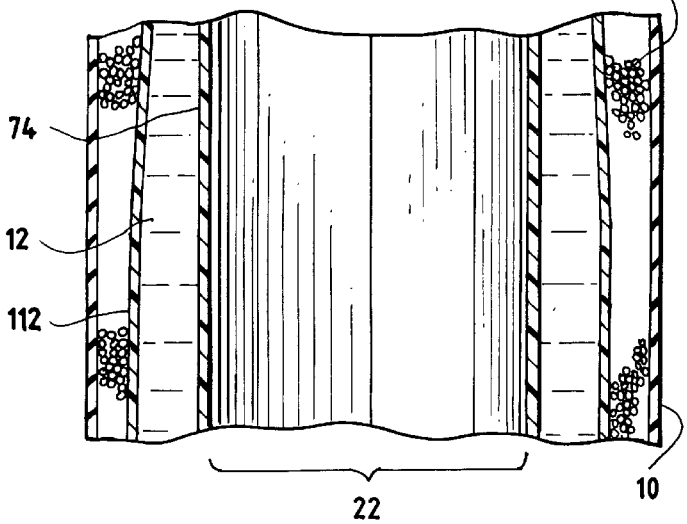
FIG. 6 is an enlarged sectional view of the body.
Figure 7:
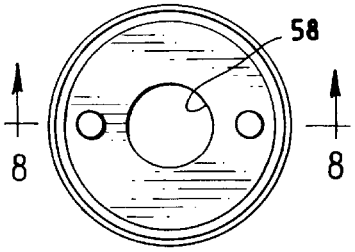
FIG. 7 is a top view of the spring assembly taken from line 7—7 in FIG. 2.

With reference to the drawings and in particular to FIGS. 7, 5, and 6 thereof, a Binder for Feeding Bottles according to the present invention comprises a conical head, as shown in FIG. 5, which surface is partially covered with hepatic harmless soft material preferably rubber having a thickness of approximately one-fourth of an inch such that the covering of the conical head of the weaning device designated by the numeral 28 anatomically stimulates like the Areola surface areas of the natural breast when an infant touches, grasps or holds it while being fed and a body, as shown in FIG. 6 designated by the numeral 10 which surface is covered with soft elastic rubber material that has microscopic air cells.

Embedded beneath the surfaces of conic head-cover 28 and body-cover 10 are padded batting-filler designated by numeral 20 which is made of dry soft textile fabric material and a foam rubber or preferably a foam material more resilient, having a thickness of approximately half an inch which makes the weaning device seem to feel softer when touched, held or grasped.

Figure 1:
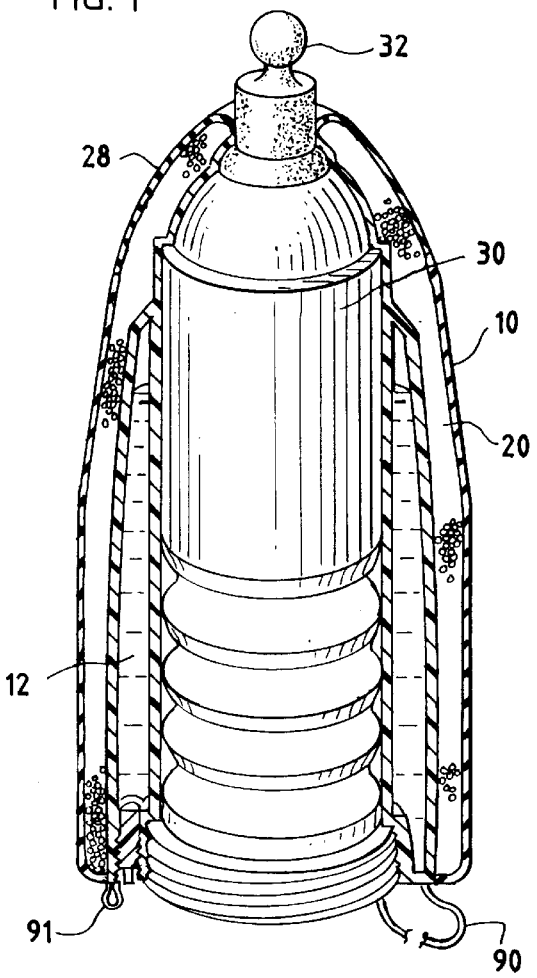
FIG. 1 is a partly in cross section perspective of the present invention.
Figure 2:
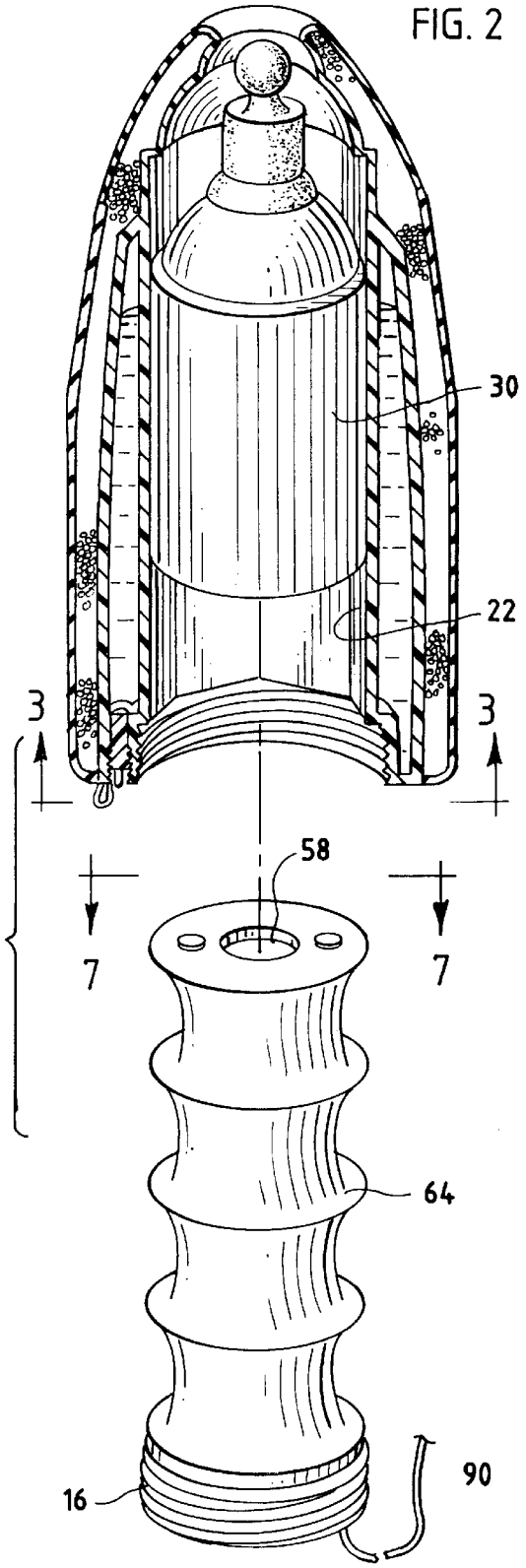
FIG. 2 is a partly in cross section exploded perspective of the present invention.
Figure 3:
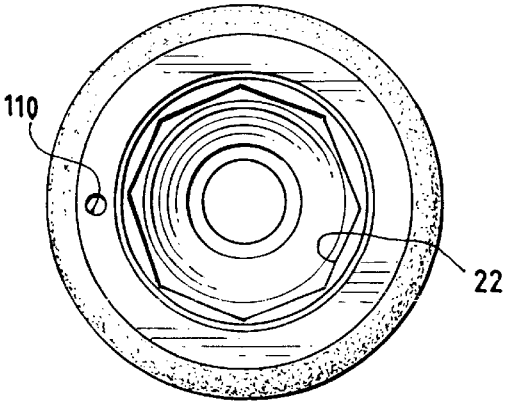
FIG. 3 is a bottom view of the present invention taken from Line 3—3 in FIG. 2.
Figure 4:
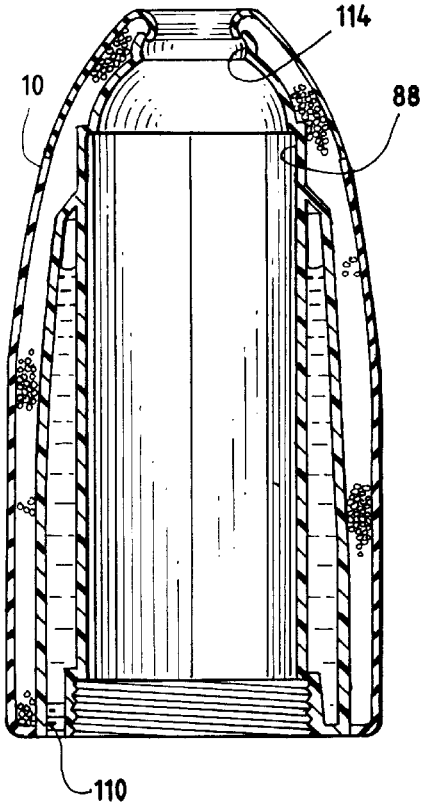
FIG. 4 is a vertical section.

As illustrated in FIGS. 1 and 2, a weaning device encases nursing (feeding) bottles designated by the numeral 30 and a nipple 32 of the flexible kind, such as those frequently used in baby feeding. Accordingly, in particular to FIG. 1 shows in detail the partly in cross section perspective view of the present invention with feeding bottle 30 properly fastened with a spring assembly, as shown in FIG. 8, screwed into the weaning device and nipple 32 of nursing (feeding) bottles is exposed beyond the end surface of an orifice 98 of the weaning device so that an infant can grasp the nipple with its lips in order to be fed.

Figure 8:
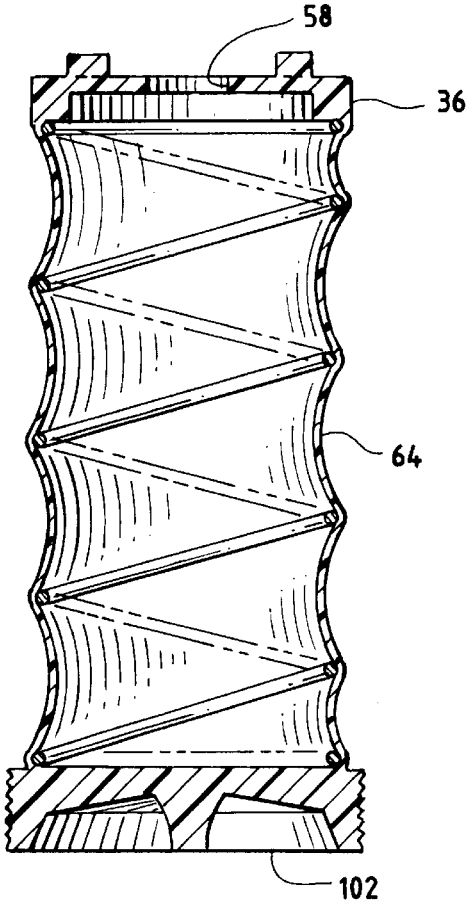
FIG. 8 is a vertical section of the spring assembly taken from lines 8—8 in FIG. 7.

Accordingly, the weaning device when in use, after the user of the weaning device had put food into the feeding bottle 30 as he or she desires and closes the feeding bottle's cap tightly, the user's first step is to simply insert the upper portion of feeding bottle 30 which of course should include the nipple 32, first, through longitudinal through hole 22 which is located at the bottom of the weaning device, then, carefully, slide in the remaining lower portion of the feeding bottle 30 and fasten feeding bottle 30 with the spring assembly as shown in FIG. 8 and as it is illustrated in FIG. 2.

How does the procedure of inserting feeding bottle 30 through longitudinal through hole 22 described above possible? The longitudinal through hole 22 conformed to a radial dimension larger than the radial dimension of any conventional feeding bottles and thus has the capacity of elasticity that is it can be stretched out and flexible which enables longitudinal through hole 22 to receive any size or shape of conventional nursing (feeding) bottles. Also, the wall that bounds the longitudinal through hole 22 which is designated by the numeral 74 is flexible.

Accordingly, longitudinal through hole 22, as shown in FIG. 6, is composed of a lower passage 118 which tapers into an aperture, orifice 98, which can be stretched and flexible and conformed to a radial dimension larger than the radial dimension of any conventional nipple. Therefore, nipple 32 of feeding bottle 30 can be exposed beyond the end surface of orifice 98. Also, within longitudinal through hole 22 is lower flange 88 which is stretchable and flexible so also is upper flange 114. Both flanges are adapted to support the neck and the cap of feeding bottle 30 respectively.

How does the spring assembly, as shown in FIG. 8, function as to fastening, to adjusting, and to securing feeding bottle 30? Bottom of feeding bottle 30 rests on cradle 36 as shown in FIG. 7 and a hole 58 which allows accumulated air inside the spring assembly to be discharged as the spring assembly is compressed while fastening the feeding bottle 30 and between cradle 36 and spring handle 102, is a resilient spring 64 is preferably made of rubber material which enables feeding bottle 30 of any size or shape to fit into positioning by screwing threadings 16 of spring assembly against the weaning device such that the spring assembly provides a reliable safety catch whereby a child is incapable of removing or pulling it out while feeding or fiddling. This ultimately protects the child from harm or injury because if the child is capable of pulling out the spring assembly after the feeding bottle has been secured, adjusted and fastened by the spring assembly, the feeding bottle will slide out of the binder to harm or injure the child. For safety or misplacement purposes, a chain 90 attaches the spring assembly, as shown in FIG. 8, to the weaning device.

Figure 9:
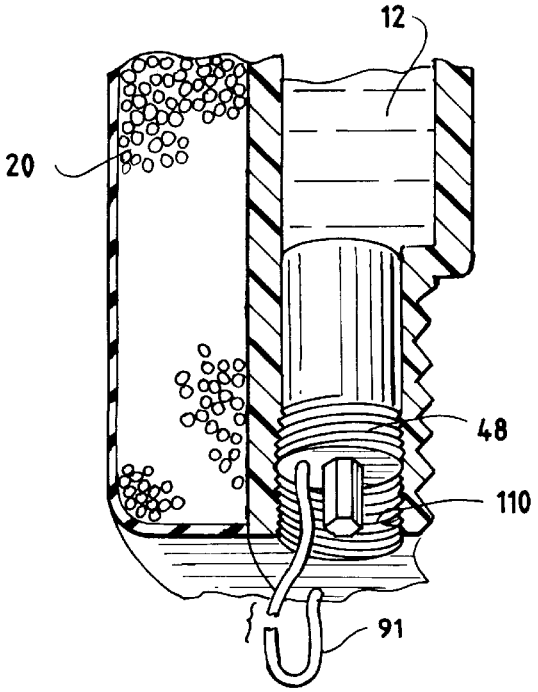
FIG. 9 is a detail view of the plug assembly.

Looking now at the configuration of FIGS. 9 and 6, in particular to FIG. 9 thereof is a detailed view of the plug assembly according to the present invention. The plug assembly, as shown in FIG. 9, is formed with a tubular member with threadings to be screwed against inlet 110 such that the plug assembly provides a fluid tight seal and a reliable safety catch whereby a child is incapable of removing or pulling the plug assembly out after being fitted into 110 while feeding or fiddling thereby protecting the child from any harm or injury. This is because if the child is capable of pulling out the plug assembly after it has been properly fitted into 110 to stop the water from flowing out, the hot water from the water container tube will be drained suddenly and possibly causing harm or injury to the child, and the plug assembly is provided with a plug handle 48.

To put water into inlet 110, the user should invert the weaning device and pour approximately in 200 to 300 milliliters of water in the range of 25° C. to 70° C. through inlet 110 into water container-tube 12 and then use the plug assembly, as shown in FIG. 9, for the fitting into inlet 110. The paramount recommended ingested baby's food temperature treatment in order to be served warm, it must be about or substantially above 0° C. temperature. To be most effective, for optimum result, hot water in the range of 25° C. to 70° C. must be maintained or adhered to. If the temperature falls below the optimum range then the desired result is ineffective. However, if the temperature is above the optimum range, for example, mouth bums may occur. To drain the water from water container tube 12, the user should unscrew the plug assembly, as shown in FIG. 9, by its plug handle 48. In climates where the temperature remains below freezing, for freeze protection, the water used for heat storage must be drained when the binder is not in use or after utilizing the hot water. For safety or misplacement purposes, chain 91 attaches the plug assembly to the weaning device.

As illustrated in FIGS. 1, 6 and 9, a water-container-tube which holds the water used for heat storage is designated by the numeral 12 is formed with a minimal heat transfer non-metallic material—that transfers heat via longitudinal non-metallic longitudinal —wall 74 —preferably made of flexible plastic —to the baby's food in the feeding bottle. The minimal amount of heat transfer to the baby's food in the feeding bottle is accomplished gradually by the process of convection. The geometrical form of the non-metallic body as well as the thermal conditions prescribed over its bonding surfaces are such that heat flows only in one direction that is from water-container-tube 12 to the baby's food in the feeding bottle 30 via longitudinal wall 74 preferably made of flexible plastic. The hot water serves as the heat transfer medium or heat source. Some amount of heat from the hot water is transferred via the water container tube 12 in contact with the surface of the longitudinal wall 74 which in turn is aligned in tangential contact with the feeding bottle thereby some amount of heat transfer to the baby's food in the feeding bottle is accomplished such that the baby's food will retain or absorb some amount of heat sufficient for a desired period of time which will keep it warm at least above 0° C. temperature. However, other apparent functions of the water container tube and the plastic longitudinal wall could serve as heat insulating elements for the purpose of keeping the baby's food in the feeding bottle warm are optional, and it does not form an essential portion of this device.

Between water-container tube 12 and batting-filler 20 is insulator longitudinal mall 112 which is formed with insulator materials that insulate heat from getting to the surface of the weaning device. However, except for an insignificant amount of heat that gets to the surface of the weaning device that is adapted to conform partially to the warmth of natural breast that infants are accustomed to.

The weaning process is sustainable by a simple technique of not restraining the baby's hands from grasping, holding or touching the weaning device while being fed. This simple technique also trains the infant to associate the weaning device with the natural breast and, moreover, to get used to a new taste since the content of the baby's food may vary.

The present invention holds that the dimensions, advantages, descriptions and particulars are evidenced by its uniqueness in eliminating easily problems parents and their infants face during weaning periods. Among other things, it is understood that the present disclosure is made by way of example only and that numerous changes in the detail of construction and the combination and arrangement of parts may be resorted to without departing from the spirit and scope of the invention as determined by the appended claims and their legal equivalents.

What is claimed:

1. A binder for weaning children for binding a nursing feeding bottle comprising:

a padded tubular bag-like element made of elastic material having a conical head and formed with a longitudinal through hole at the center and a threaded member within the said longitudinal through hole at the bottom, said longitudinal through hole having a predetermined cross-sectional shape and defining an opening communicating from the bottom of the bag-like element to the top thereof, said longitudinal through hole being composed of a lower passage and an upper passage between which there are a lower flange and an upper flange adapted to support a neck and a cap of a nursing feeding bottle having a nipple for suckling; and a spring assembly member formed with an air vent opening at a top and provided with a tubular member and a threaded member, said tubular member and said threaded member are being adapted to be inserted into the longitudinal through hole at a bottom end of the bag-like element; the tubular member having a resilient spring designed for enabling a conventional nursing feeding bottle of any type of length or size to adjust into position within the longitudinal through hole with the spring assembly bearing against a bottom end of a nursing feeding bottle; the threaded member designed for screwing against the bag-like element of said threaded member within said longitudinal through hole at the bottom to reliably secure a nursing feeding bottle and to provide a safety catch;

and a water container tube disposed in the longitudinal through hole to hold liquid used for heat storage and having an inlet provided with a threaded portion receiving said liquid; and a plug assembly member provided with a tubular portion and a threaded portion, said tubular portion and said threaded portion are being adapted to be inserted into said inlet; the tubular portion designed for plugging said inlet to prevent fluid leakage; the threaded portion designed for screwing against the threaded portion of the inlet to provide fluid tight seal.

2. A binder for weaning children for binding a nursing feeding bottle defined in claim 1, wherein said water container tube is formed of non-metallic material.

3. A binder for weaning children for binding a nursing feeding bottle defined in claim 1, wherein said conical head is partially covered with haptic harmless soft material.

4. A binder for weaning children for binding a nursing feeding bottle defined in claim 1, wherein said bag-like element surface body portion is substantially covered with soft elastic rubber materials comprising microscopic air cells.

* * * * *